United States Patent [19]

Babicz

[11] 4,327,992

[45] May 4, 1982

[54] DRIVING ARRANGEMENT FOR PHOTOCOPY MACHINE

[75] Inventor: Thaddeus W. Babicz, Arlington Heights, Ill.

[73] Assignee: APECO Corporation, Des Plaines, Ill.

[21] Appl. No.: 167,453

[22] Filed: Jul. 10, 1980

[51] Int. Cl.[3] ..... G03G 15/00

[52] U.S. Cl. ..... 355/3 R; 355/3 DR

[58] Field of Search ..... 355/3 R, 3 DR, 11, 8

[56] References Cited

U.S. PATENT DOCUMENTS

| | | | |
|---|---|---|---|
| 3,490,842 | 1/1970 | Reick et al. | 355/10 |
| 4,124,289 | 11/1978 | Miyata et al. | 355/8 X |
| 4,165,168 | 8/1979 | Baumann et al. | 355/3 R |

*Primary Examiner*—Richard L. Moses

*Attorney, Agent, or Firm*—Leydig, Voit, Osann, Mayer & Holt, Ltd.

[57] ABSTRACT

A photocopy machine having a drum and associated rollers driven by a flexible drive belt. A first gear train is connected between the drive belt and the drum for driving the drum at a low speed. A second independent gear train is connected between the drive belt and the rollers for driving the rollers at a relatively high speed, the gear trains being connected to the belt at points separated from one another. The drum and rollers are mounted in a drawer frame providing "pull out" movement with respect to a main frame. First and second one-way clutches of the axially separable type are interposed in the respective gear trains and axially oriented between the frames for completing separate drive connections in the trains when the drawer frame is closed in operating position, with the drive connections being broken when the drawer is pulled out for inspection or servicing. In the preferred embodiment of the invention the drum has a through-axle with a third one-way clutch of the axially separable type mounted in the drum and telescopingly receiving the axle for coupling the drum to the axle. This permits the axle to be withdrawn from the drum and from the frame when the drawer frame is in its pulled out position to free the drum and to enable the drum to be lifted vertically out of the machine for replacement or maintenance. The one-way clutches are of the type having peripherally spaced ramp supported rollers.

7 Claims, 10 Drawing Figures

Fig. 1a.
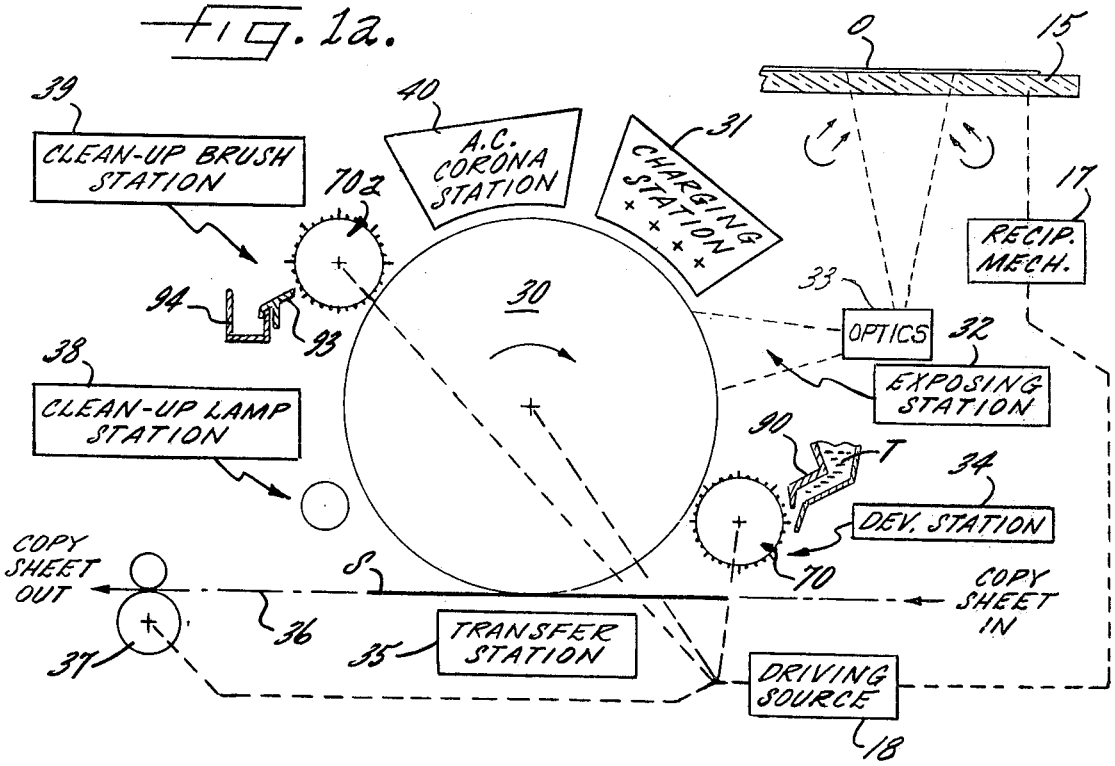
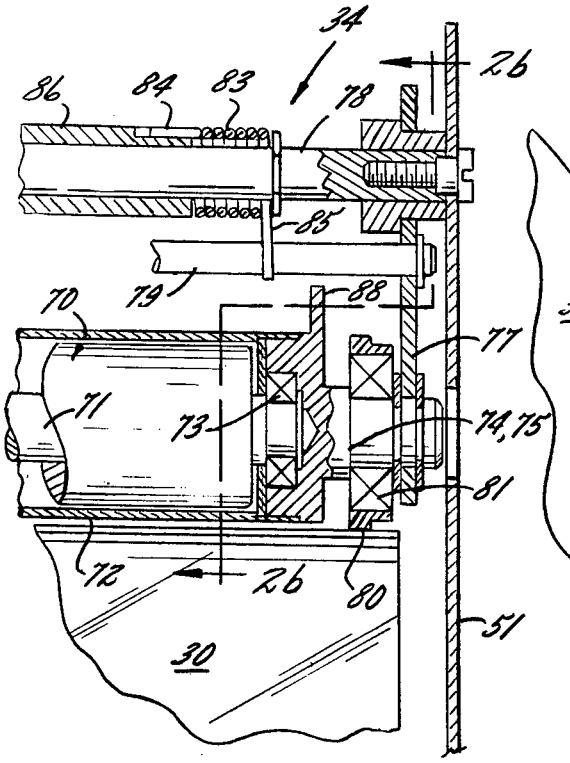
Fig. 2a.
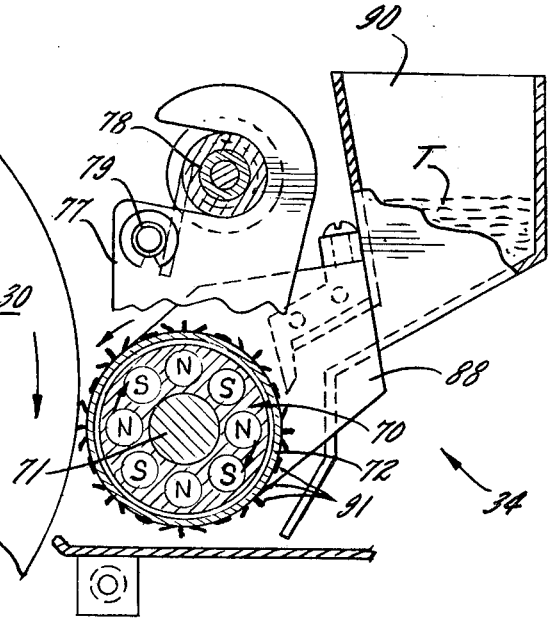
Fig. 2b.

DRIVING ARRANGEMENT FOR PHOTOCOPY MACHINE

In order for the copies made by a photocopy machine to be clear and accurate it is necessary for the photosensitive drum which receives the optical image to operate at a speed which is absolutely constant and unaffected by the other operations going on within the machine which are powered by the same driving motor. It is also desirable, in the photocopy machine, to mount the drum and associated rotating elements in a drawer-like frame which may be pulled out for purposes of inspection and servicing. Mounting the drum and its associated rollers on a drawer has, in the past, complicated the drive system and has prevented the drum drive from being isolated from the rest of the drive system. Moreover, mounting the drum in the drawer has given rise to phasing problems when the drawer is pushed into working position from its pulled out position following inspection.

It is, accordingly, an object of the present invention to provide a drive system for a photocopy machine employing a photosensitive drum which permits the drum and its associated rollers to be pulled out, drawer-like, for inspection or servicing but which nevertheless provides for substantial isolation between the driving elements for the drum and rollers, respectively.

In this connection it is an object to provide a drive system for a photocopy machine which is capable of producing copies which are more clear and accurate than have been possible in comparable machines in the past.

It is a more specific object to provide a photocopy machine having a drawer frame for mounting a photosensitive drum and its associated rollers in which separate drive connections are provided between the drawer frame and the main frame which supports it without, however, giving rise to any phasing problems incident to re-connection as the drawer frame is moved back into its closed operating position following inspection or servicing. Thus it is a general object to provide a photocopy machine having a photosensitive drum and associated subassemblies requiring periodic inspection or servicing which are mounted upon a pull out drawer for clear visibility and convenient access and in which the drawer may be pulled out or pushed in with complete freedom and without regard as to whether the drive couplings occupy a particular relative phase position.

It is a more specific object of the invention to provide in a photocopy machine a pull out drawer having two disengageable drive couplings with the drive mechanism in the main frame and in which the drive couplings are in the form of axially separable one-way clutches, preferably of the roller type, providing complete freedom of axial entry and exit without regard to phase.

It is an object of the invention in one of its aspects to provide a drum having a through-axle journaled in a drawer frame with a first one-way clutch being provided at the end of the axle and a second one-way clutch being interposed between the drum and the axle with both of the clutches being of the axially separable type permitting the drum to be removed from the frame simply by withdrawal of the axle from the machine.

It is a general object to provide a photocopy machine having a novel driving arrangement which permits the making of clear and accurate copies combined with convenient access for inspection and servicing but which is, nonetheless, highly economical to construct, highly reliable in operation and substantially maintenance free.

Other objects and advantages of the invention will become apparent upon reading the attached detailed description and upon reference to the drawings in which:

FIG. 1 shows in perspective a photocopy machine constructed in accordance with the present invention and with the drawer frame which contains the drum shown in its pulled out position.

FIG. 1*a* is a schematic diagram showing the various stations surrounding the photosensitive drum required in the making of a typical photocopy.

FIG. 2 is an elevational view of the drawer frame as viewed along line 2—2 in FIG. 1.

FIG. 2*a* is a fragmentary section taken through the developing assembly as viewed along line 2*a*—2*a* in FIG. 2.

FIG. 2*b* is a broken section through the developer roller taken along line 2*b*—2*b* in FIG. 2*a*.

Figure 1:
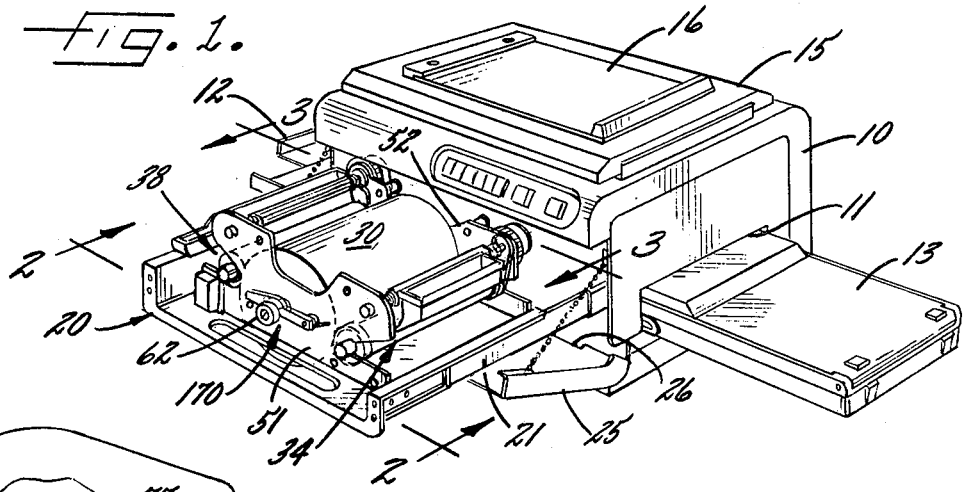

While the invention has been described in connection with a preferred embodiment, it will be understood that I do not intend to be limited to the particular embodiment shown but intend, on the contrary, to include the various alternative and equivalent constructions included within the spirit and scope of the appended claims. Referring now to FIGS. 1 and 1*a* there is shown a photocopy machine having a housing 10 with a copy sheet inlet, or entry way, 11 at one end and a copy sheet outlet in the form of a tray 12 at the other. Fitted into the entry way is a cassette 13 which contains and protects a stack of blank copy sheets and which may be constructed as disclosed in co-pending application Ser. No. 187,513 filed 9-15-80, now U.S. Pat. No. 4,306,802.

At the top of the machine is a longitudinally reciprocating platen 15 which supports the original document O which is held in face down condition by a flexible cover 16. The platen is reciprocated by a reciprocating mechanism generally indicated at 17 which is coupled to a driving source 18 which may for example be in the form of an electric driving motor.

In carrying out the present invention important operating parts of the machine, and particularly those requiring periodic inspection or servicing, are mounted upon a pull out drawer frame 20 mounted on a pair of slides 21, 22 (see FIG. 2) which are in turn supported upon a main frame 23. The housing includes a side panel 25 for enclosing purposes but which is hinged along its lower edge 26 to permit dropping to the out-of-the-way position illustrated in FIG. 1 to permit the drawer frame 20 to be pulled out.

Prior to referring to the mechanical details of the construction which distinguish the present invention, consideration may be given to FIG. 1*a* which is a diagram showing the photosensitive drum and associated parts required to produce a plain paper photocopy of an original document. It will be assumed that it is desired to copy the original document O on a copy sheet S which is fed, by means not shown, from the cassette 13. The drum, indicated at 30, will be understood to have on its surface a deposited layer of selenium or equivalent photosensitive material. An all-over positive electrostatic charge is applied to the surface in a charging station 31. The drum, upon rotation by the driving source 18, in the direction of the arrow passes through an exposing station 32. In the exposing station optics, generally indicated at 33, cast the optical image of the original document onto the surface of the drum where the light dissipates the charge in the light struck areas resulting in an electrostatic image in the form of positive charges in the non-light struck areas. The electrostatic image passes into a developing station 34, to be subsequently described in detail, where a pigmented toner in finely divided form is brought into contact with the surface of the drum adhering to the charged areas thereby developing the image.

The developed image, in the form of the deposited toner, enters a transfer station 35 where the copy sheet S is brought into contact with the toner. A positive charge applied to the back of the sheet causes the toner to leave the drum and to be deposited upon the face of the sheet. The sheet subsequently follows a path 36 to a pair of fusing rollers 37 where the toner is pressed into the sheet, following which the sheet is discharged into the tray 12 (FIG. 1).

Meanwhile continued rotation of the drum causes the area which held the developed image to be passed into a clean-up lamp station 38 in which the drum is brightly illuminated to dissipate any residual charge. The surface of the drum next enters a clean-up brush station 39, to which further reference will be made, where any residual toner is brushed from the surface of the drum. Finally, the surface of the drum enters an AC corona station 40 which applies a high alternating potential so that the charge on the drum is reduced to a reference, or neutral, state in readiness for entry into the charging station to begin a new cycle.

In considering the present invention attention will first be given to the construction of the drawer frame 20 and the components which are mounted upon it, following which the drive system will be considered.

The drawer frame is made up of a pair of spaced vertical frame plates, 51 at the front and 52 at the rear, joined by axially extending cross members 53, 54. Nested between the frame plates 51, 52 is the drum 30 of hollow construction having circular ends 55, 56 through which extend an axle 60 having an inner projecting end 61 and an outer projecting end 62. The ends are journaled in bearings 63, 64, respectively. As will appear, the inner end 61 of the shaft is gripped and rotated at a slow but precise rate of speed. The term "slow" is a relative term; comparing its speed to the speed of the associated rollers, indeed, the speed of the drum is sufficient so that the production rate is equal to, or exceeds, the production rate of competitive machines.

Turning attention to the developing station 34 it includes a developer roller 70 having a shaft 71 and surrounded by a thin non-magnetic cylindrical shell 72. The ends of the roller 70 are mounted in anti-friction bearings 73 supported in relatively stationary hubs 74, 75, respectively. The hubs are suspended upon pivoted arms, or hangers 77 pivoted at the ends of an axially extending shaft 78. The hangers are interconnected by a tie rod 79.

For the purpose of maintaining a constant spacing between the roller 70 and its shell 72 on the one hand and the surface of the drum on the other, bearer rings 80 are provided at the ends of the roller and which are rotatable about anti-friction bearings 81.

For the purpose of biasing the bearer rings, and hence the developing roller, into a snug working condition with respect to the drum, coil springs are provided at each end of the shaft 78, the springs being anchored to an adjustable sleeve for equalizing and adjusting the applied torsion. The springs, indicated at 83, have a relatively fixed end 84 and a torsion applying end 85. The fixed ends of the two springs are keyed to a torsion adjusting sleeve 86 which is fixed to the shaft 78 by a set screw 87. The torque applying ends 85 of the springs bear against the tie rods 79, the ends of which are received in the hangers 77, so that the springs exert equal torque at a high enough level to keep the bearers 80 and rollers 70 in seated position.

In practicing the present invention the rollers 70, rotated by shaft 71, is provided with longitudinally extending lines of magnetism forming poles of alternating north and south polarity, as indicated in FIG. 2*b*, four pairs of poles, or a total of eight, being preferred. Such poles are rotated in the direction of the arrow which is applied to the roller 70, but the outer shell 72 which surrounds the rotor is kept stationary. This is assured by the arms 88 (FIGS. 2*a* and 4) which are secured to the stationary hubs 74, 75 and which support the toner reservoir.

For the purpose of feeding finely divided, pigmented toner to the developer roller for application to the surface of the drum a toner reservoir 90 is provided, mounted within the drawer frame, with the body of toner being indicated at T (FIG. 2*b*). In carrying out the invention the toner is of a known self-magnetic type which contains a ferromagnetic substance. The toner is attracted toward the outer surface of the shell by the magnetic lines of flux set up by the north and south poles forming longitudinally extending bristles 91. Because of the composition of the toner and the friction at the surface of the shell 72, the bristles 91 do not follow the poles on the rotor. On the contrary the bristles 91 pivot about their lower ends as the rotor rotates and proceed slowly in a direction opposite to the direction of roller rotation. In a typical set-up, employing a roller speed on the order of 500 to 800 rpm., precession of the bristles occurs in the opposite direction at a rotational speed of only a few rpm. As the bristles, proceeding counterclockwise in the direction of the arrow (FIG. 2*b*) wipe across the surface of the drum, which is rotating clockwise but at a lesser rate of speed, some of the toner leaves the bristles and becomes attached to the charged areas of the drum to a density which is dependent upon the strength of the charge. This results in a fully developed image but without any of the toner being deposited in a non-charged area, an image which is ready for transfer to the copy sheet S at the transfer station 35.

After the copy sheet is peeled from the drum at the downstream side of the transfer station the active area of the drum passes through the clean-up lamp station 38 where a bright light serves to dissipate any residual charge, which unbinds any residual toner which may remain on the drum surface. Such toner is removed at the clean-up brush station which employs a brush forming assembly which is substantially identical to that at the developing station and which has been described in connection with FIGS. 2*a* and 2*b*. For the sake of simplicity corresponding reference numerals have been utilized to indicate corresponding parts. The only difference is that instead of providing a toner reservoir 90 for feeding toner to the roller 70, or rather to the shell 72 which surrounds it, means are provided for constantly removing the residual toner which is picked from the drum by the clean-up roller 70*a*. This means includes a longitudinally extending knife 93 which clips the bristles to a constant short length with the excess, or clipped, toner being deposited in a collector trough 94. In the case of the developer roller the presence of a electrostatic charge on the drum causes deposition of toner in the charged areas, whereas the lack of an electrical charge on the drum at the clean-up position causes any small amount of toner which may remain on the drum surface to be picked up by a combination of magnetism and a sweeping action. The surface thus cleaned by the brush, upon being subjected to a high voltage AC field at the corona station 40 is reduced to a neutral condition in readiness for recharging and the beginning of a new copying cycle.

Figure 5:
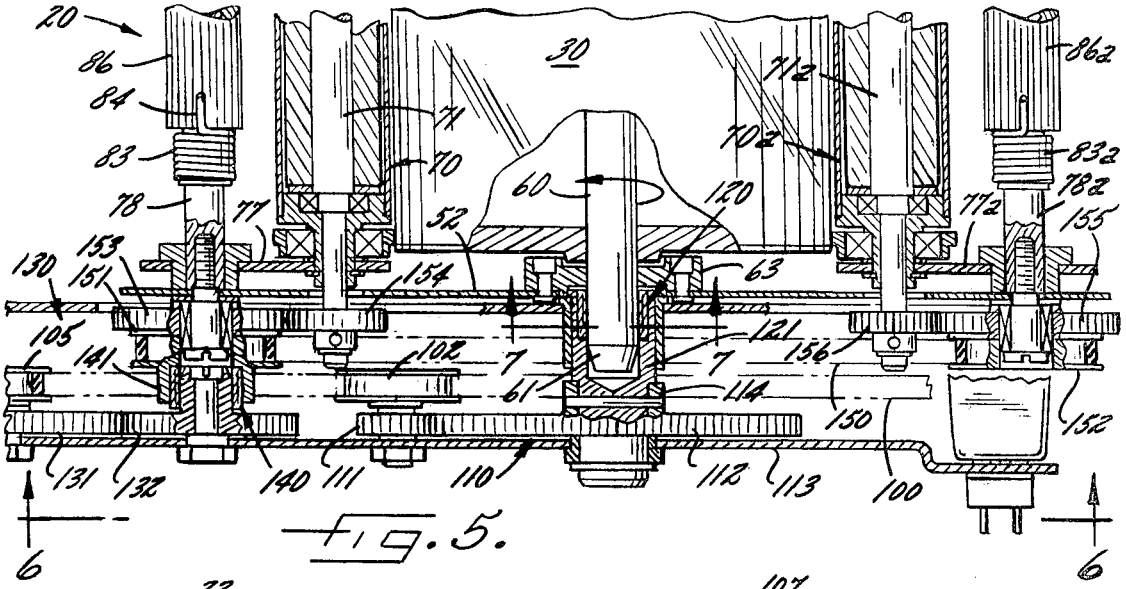
FIG. 5 is a fragmentary laid-out section substantially in plan view, looking along line 5—5 in FIG. 3.
Figure 6:
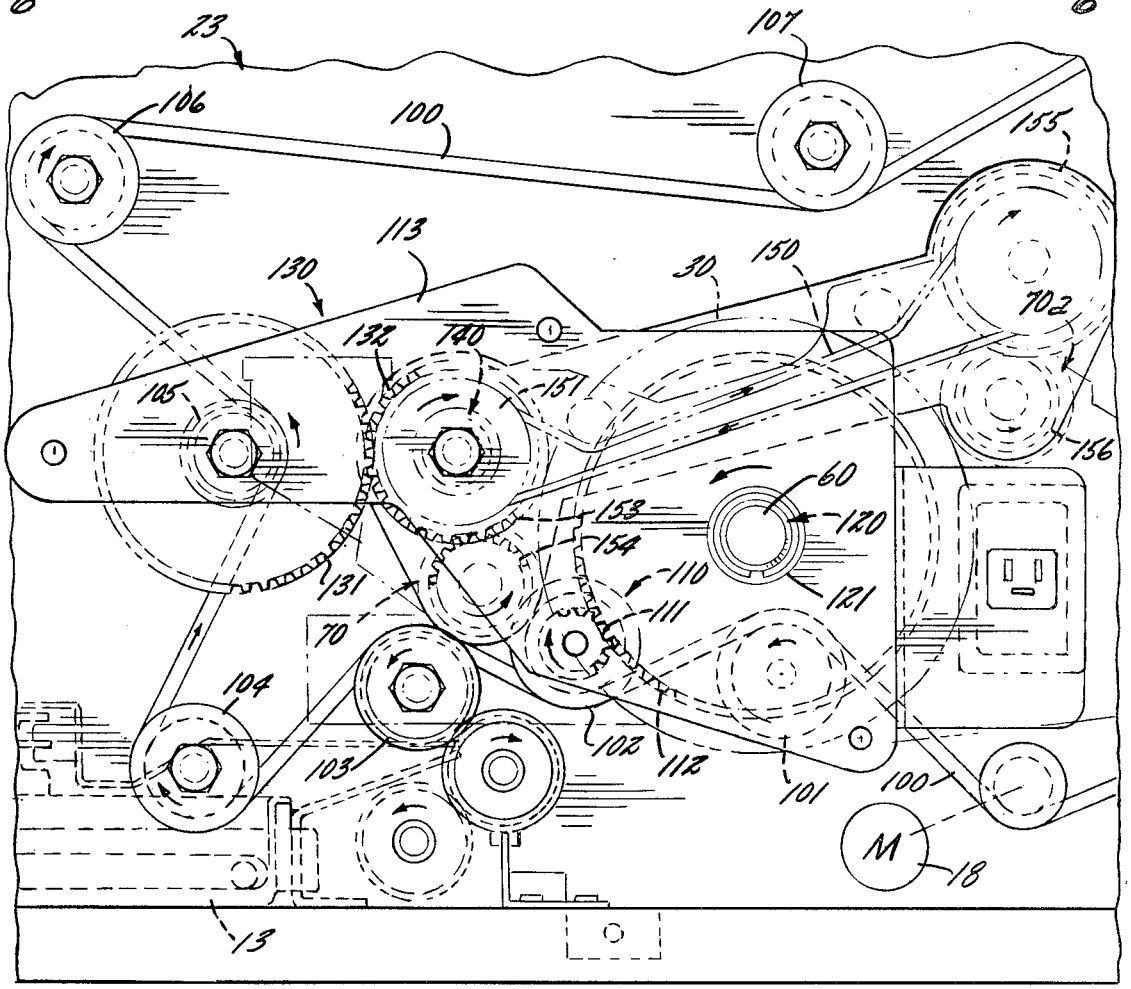
FIG. 6 is an elevational view of the drive system as viewed along line 6—6 in FIG. 5.

In accordance with the present invention a flexible drive means, e.g., a chain or a doubly faced cog, hereinafter referred to generally as a drive belt, is provided connected to the driving source. A first gear train is connected between the drive belt and the drum for driving the drum at a low speed while a second independent gear train is connected between the drive belt and the rollers for driving the rollers at relatively high speed, the gear trains being coupled to the belt at points separated from one another. Further in accordance with the invention at least the drum, developer roller, clean-up roller and associated parts are mounted on the drawer frame and first and second one-way clutches of the axially separable type are interposed in the respective gear trains and axially oriented between the frames for completing separate drive connections when the drawer frame is closed and for breaking the drive connections when the drawer frame is pulled out. Turning to FIGS. 5 and 6 which show the drive system in some detail, the flexible belt 100 passes, in the direction of the arrow, around pulleys 101–107 inclusive. It will be understood that there are still other pulleys which are operated by the belt 100, for example the pulley required to drive the platen reciprocating mechanism 17, but such additional pulleys are not required for an understanding of the present invention.

Attention will first be given to the means for driving the drum 30. The drum is driven by a first gear train 110 consisting of a first gear 111 of small diameter and a second gear 112 of large diameter resulting in a speed reduction. Such gears are mounted upon a fixed frame plate 113 which forms a part of the main frame 23. The hub 114 of the gear 112 is coupled to the presented end 61 of the drum shaft by means of a one-way clutch 120 of the axially separable type, the details of which are set forth in enlarged form in FIG. 7. By a clutch of the axially separable type is meant a clutch which has an inner shaft and a concentric outer sleeve with clutching means acting radially between them but with the shaft and sleeve being completely disengageable from one another by telescoping action. In the preferred form of clutch 120 there is an outer sleeve 121 defining an annular space which is occupied by a series of peripherally spaced captive rollers 122, the outer sleeve being formed with ramps 123 for the individual rollers. The rollers are kept in their spaced positions by means of a cage 124. When the outer sleeve 120 is rotated in the clockwise direction as viewed in FIG. 7, the effect is to increase the space available to the rollers so that the rollers are loose and no torque is transmitted between the sleeve and the shaft. However, when the gear 112 and outer sleeve 121 are rotated in the counterclockwise direction, in other words the normal driving direction, the ramps are rotated with respect to the rollers which they contain so that the rollers are crowded inwardly upon the shaft thereby forming a torque transmitting connection. It is one of the important features of the present invention that when no torque is being transmitted through the clutch the rollers are loose so that the presented end 61 of the drum shaft can be readily inserted or withdrawn without any obstruction or any friction and without consideration of any phase relationship between the input and output elements.

In accordance with a further feature of the invention a second, independent, gear train is connected between the drive belt and the rollers 70,70*a* for driving them at high speed and a second one-way clutch of the axially separable type completes a separate drive connection when the drawer frame is closed in operating position. Such second gear train, indicated at 130, is formed by a first gear 131 and a second gear 132. The second gear is coupled by means of a one-way clutch 140 having a central shaft 139 surrounded by a sleeve 141. Interposed between the shaft and the sleeve are a set of peripherally spaced rollers acted upon by respective ramps just as in the case of the structure disclosed in FIG. 7, and the operation is the same: torque is exerted in the driving direction.

Figure 3:
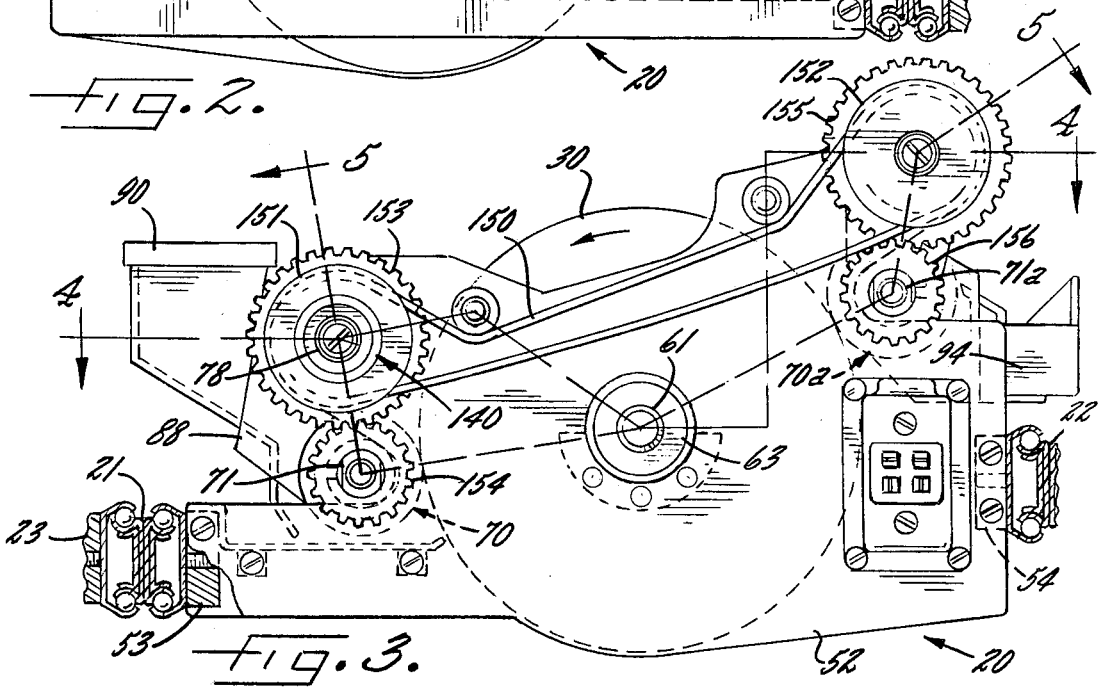
FIG. 3 is a rear elevational view of the drawer frame of FIG. 2.

In carrying out the invention the second one-way clutch 140 drives not only the developer roller 70 but also the clean-up roller 70*a*. This is accomplished by an interconnection on the drawer frame in the form of an auxiliary belt 150 (see FIG. 3) which is trained about a first pulley 151 associated with the developer roller and a second pulley 152 which is associated with the clean-up roller. For transmitting torque from the pulley 151 to the developer roller 70 a set of meshing gears 153, 154 is used. The first of these gears is centered on the hanger shaft 78 while the second one of the gears is secured to the shaft 71 of the developer roller. This insures that the gears remain in constant mesh regardless of the swinging of the gear 154 with respect to the gear 153 by reason of the hanger 77.

In the same way there is associated with the pulley 152 a gear 155 which is in mesh with the gear 156 on the shaft 71*a* of the clean-up roller 70*a*. As a result, when the drawer frame is in its operating position and the one-way clutch 140 is assembled, rotation of the gears 131, 132 of the drive train, transmits torque through the second one-way clutch 140 to rotate both the developer roller 70 and the clean-up roller 70*a* in the directions indicated by the arrows (FIG. 6). In the case of both the developer and clean-up rollers the direction of rotation of the bristles thereon is such as to move in the same direction as the adjacent surface of the drum being acted upon, but at a higher rate of speed.

The above driving arrangement is distinguished by use of two separate drive trains for the drum and for its associated rollers with each drive train having a one-way clutch of the axially separable type for completing drive connections when the drawer is closed and for breaking the drive connections when the drawer is pulled out for inspection or servicing. The isolation provided by the two gear trains insures that the drum will be driven at a relatively slow but highly precise rate of speed, a speed which is coordinated with the speed of the reciprocated platen, thereby resulting in a clear and exact image on the drum insuring high quality of the photocopy. A clear and exact copy is also assured because of the positive driving non-slip characteristic of the two one-way clutches when actuated in their driving direction. Equally important is the fact that, notwithstanding the positiveness of the drive, the clutches are assembled and disassembled as the drawer frame is closed and opened by the free passage of the shaft into a nest of loose rollers without any friction or opposition. To insure that there is no obstruction to entry of the shaft into the position between the rollers, the shaft is preferably conically tapered at the tip (see shaft 60 in FIG. 5). This is to be distinguished from other clutching arrangements, for example of the spline type, which are phase sensitive and in which special care must be exercised in pre-positioning the engaged elements before the drawer is closed.

In accordance with one of the aspects of the present invention a third axially separable one-way clutch is interposed between the drum axle and the drum for establishing a drive connection between the two while permitting the axle to be withdrawn from the drum so that when the drawer is in its pulled out position the drum may be lifted vertically from between the frame plates for replacement or maintenance. Further in accordance with the invention retainer means are provided for keeping the axle normally in its inserted position but the retainer is releasable for withdrawal of the axle.

Figures 4, 7:
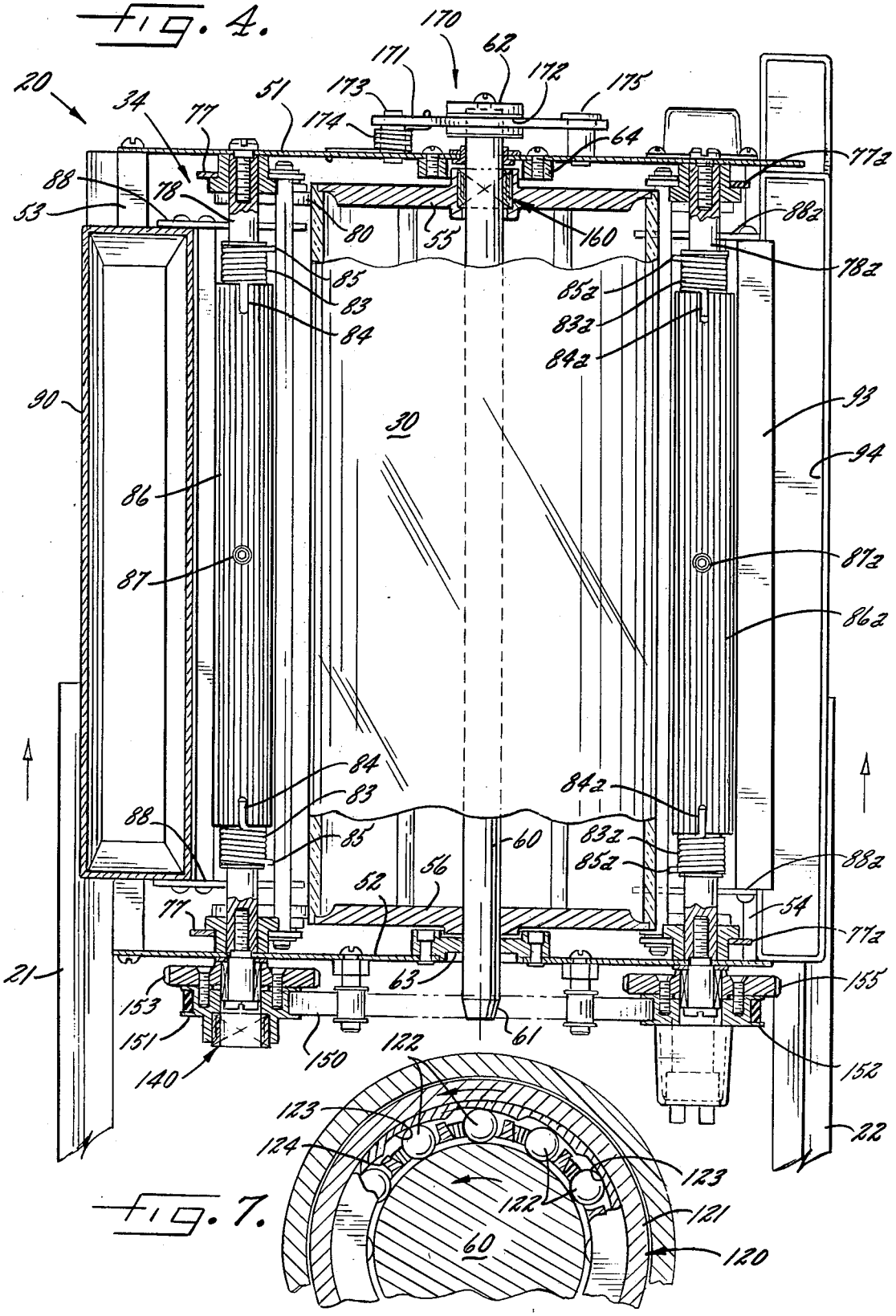
FIG. 4 is a plan view, in partial section, of the drawer frame shown in FIGS. 2 and 3.
FIG. 7 is a fragmentary section taken through the drum shaft and an associated clutch as received along line 7—7 in FIG. 5.

Referring to FIG. 4, the third one-way clutch, indicated at 160, is interposed between the end wall 55 of the drum in the shaft 60. While the one-way clutch 160 has not been illustrated in detail, it will be understood that it is constructed in the same manner as the clutch 120 set forth in FIG. 7, the only difference being that the direction of slope of the ramps is reversed from that illustrated in FIG. 7, since the direction of drive is from the inside out in the clutch 160 while the drive is from the outside in in the case of clutch 120.

The retaining means for the drum axle 60, indicated at 170, is in the form of a simple latch preventing endwise movement of the axle. The latching arrangement includes a pivoted latch member 171 which normally fits into an annular groove 172 formed in the enlarged end 62 of the axle 60. The latch member is pivoted at one end 173 about which it is biased by a spring 174. Movement of the latch member in the direction of bias is limited by a stop 175.

Figure 2:
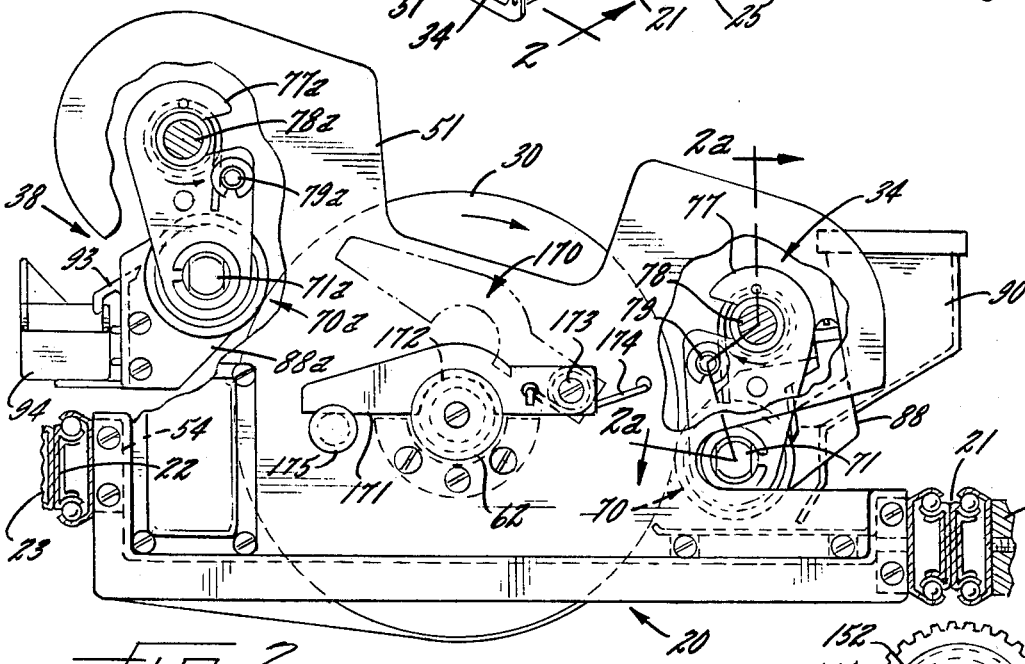

To free the axle all that is necessary is to lift the latch 171 into the dot-dash position illustrated in FIG. 2 following which the axle 60 may be outwardly withdrawn from the drum including its one-way clutch 160 at its outer end and from the bearings 63, 64 in the frame plate. As will be noted in FIG. 4, short hubs are formed on the end members 55, 56 of the drum and which are cradled in semi-circular recesses formed in the side walls of the bearings 63, 64 so that when the axle 60 is withdrawn the drum drops only a fraction of an inch and is there supported until lifted by the fingertips from the drawer frame for inspection or replacement.

What I claim is:

1. In a photocopy machine a driving source including a motor and flexible drive belt, a photosensitive drum of selenium or the like, the drum having spaced about its periphery (1) a charging station for applying an electrostatic charge evenly to the surface of the drum, (2) an exposing station having associated optics for exposing the drum to an optical image of an original document resulting in an electrostatic image on the drum in the form of charges in the non-light struck areas, (3) a developing station having a developer roller and an associated reservoir for applying finely divided toner to the surface of the drum for development of the electrostatic image, (4) a transfer station in which a copy sheet is engaged with the drum for transfer to the sheet of the developed image, (5) a clean-up station having a clean-up roller and a collector trough for removing residual toner from the surface of the drum in readiness for a new cycle, a first gear train connected between the drive belt and the drum for driving the drum at a low speed, a second independent gear train connected between the drive belt and the rollers for driving the rollers at a relatively high speed, the gear trains being connected to the belt at points separated from one another, a stationary main frame, a drawer frame having slides providing axial "pull out" movement with respect to the main frame, at least (a) the drum, (b) the developer roller and its reservoir, and (c) the clean-up roller and its collection trough being mounted on the drawer frame, first and second one-way clutches of the axially separable type interposed in the respective gear trains and axially oriented between the frames for completing separate drive connections in the trains when the drawer frame is closed in operating position and for breaking the drive connections when the drawer frame is pulled out for inspection or servicing.

2. In a photocopy machine a driving source including a motor and flexible drive belt, a photosensitive drum of selenium or the like having a projecting axle, the drum having spaced about its periphery (1) a charging station for applying an electrostatic charge evenly to the surface of the drum, (2) an exposing station having associated optics for exposing the drum to an optical image of an original document resulting in an electrostatic image on the drum in the form of charges in the non-light struck areas, (3) a developing station having a developer roller and an associated reservoir for applying finely divided toner to the surface of the drum for development of the electrostatic image, (4) a transfer station in which a copy sheet is engaged with the drum for transfer to the sheet of the developed image, (5) a clean-up station having a clean-up roller and a collector trough for removing residual toner from the surface of the drum in readiness for a new cycle, a first gear train connected between the drive belt and the drum axle for driving the drum at a low speed, a second independent gear train connected between the drive belt and the rollers for driving the same at a relatively high speed, the gear trains being connected to the belt at points separated from one another, a stationary main frame, a drawer frame having slides providing axial "pull out" movement with respect to the main frame, at least (a) the drum, (b) the developer roller and its reservoir, and (c) the clean-up roller and its collection trough being mounted on the drawer frame, a first one-way clutch of the roller type having a sleeve with ramped rollers peripherally spaced therein at the end of the first gear train for engaging the projecting drum axle, a second one-way clutch of the roller type interposed in the second gear train, the clutches being axially oriented between the frames so that drive connections are established to the drum and rollers when the drawer frame is closed in operating position and so that the drive connections are broken when the drawer is pulled out for inspection or servicing.

3. In a photocopy machine a driving source, a photosensitive drum of selenium or the like, the drum having spaced about its periphery (1) a charging station for applying an electrostatic charge evenly to the surface of the drum, (2) an exposing station having associated optics for exposing the drum to an optical image of an original document resulting in an electrostatic image on the drum in the form of charges in the non-light struck areas, (3) a developing station having a developer roller and an associated reservoir for applying finely divided toner to the surface of the drum for development of the electrostatic image, (4) a transfer station in which a copy sheet is engaged with the drum for transfer to the sheet of the developed image, (5) a clean-up station having a clean-up roller and collection trough for removing residual toner from the surface of the drum in readiness for a new cycle, a stationary main frame, a drawer frame having slides providing axial "pull out" movement with respect to the main frame, at least (a) the drum, (b) the developer roller and its reservoir, and (c) the clean-up roller and its collection trough being mounted on the drawer frame, means on the drawer frame for rotationally coupling the developer and clean-up rollers together, drum and roller driving connections on the main frame axially oriented in the direction of movement of the drawer frame and coupled to the driving source for rotation at different but related speeds, corresponding drum and roller driven connections on the drawer frame, first and second one-way clutches of the axially separable type for coaxially coupling together the respective driving and driven connections when the drawer frame is in operating position and for separating the driving and driven connections when the drawer frame is pulled out.

4. The combination as claimed in claim 1 or in claim 2 or in claim 3 in which the drawer frame includes a spaced pair of vertical frame plates between which the drum extends, the drum having an axle which is axially inserted into the drum axle with ends projecting inwardly and outwardly through the respective frame plates, and a third axially separable one-way clutch interposed between the axle and the drum for coupling the drum to the axle, retainer means for keeping the axle normally in its axially inserted position within the drum but the retainer means being releaseable to permit the axle to be withdrawn from the drum so that when the drawer is in its pulled-out position the drum may be lifted verticaly from between the frame plates for inspection or replacement.

5. The combination as claimed in claim 1 or in claim 2 or in claim 3 in which the developer and clean-up rollers are each suspended on a pair of hangers pivoted to the drawer frame for swinging movement of the rollers toward and away from the drum, means for biasing the hangers in the direction of the drum, and means including bearer rings at the ends of each of the rollers for constantly spacing the rollers closely with respect to the surface of the drum.

6. In a photocopy machine a driving source, a photosensitive drum of selenium or the like, the drum having spaced about its periphery (1) a charging station for applying an electrostatic charge evenly to the surface of the drum, (2) an exposing station having associated optics for exposing the drum to an optical image of an original document resulting in an electrostatic image on the drum in the form of charges in the non-light struck areas, (3) a developing station having a developer roller and an associated reservoir for applying finely divided toner to the surface of the drum for development of the electrostatic image, (4) a transfer station in which a copy sheet is engaged with the drum for transfer to the sheet of the developed image, (5) a clean-up station for dissipating the residual electrostatic charge and for removing residual toner from the surface of the drum in readiness for a new cycle, a stationary main frame, a drawer frame having a spaced pair of vertical frame plates between which the drum extends, the drum having a through-axle with ends projecting inwardly and outwardly therefrom and journaled in the frame plates, slides on the drawer frame providing axial "pull out" movement with respect to the main frame, a drum driving connection on the main frame coupled to the driving source and including a first one-way clutch, the clutch being of the axially separable type having a sleeve dimensioned to drivingly receive the inwardly projecting end of the axle when the drawer is in operating position and to release the end of the axle when the drawer is pulled out, a second one-way clutch of the axially separable type having a sleeve mounted in the drum and dimensioned to telescopingly receive the axle for coupling the drum to the axle, retainer means for keeping the axle normally in its axially inserted position within the drum but the retaining means being releaseable to permit the axle to be axially withdrawn from the drum and from the frame plates when the drawer frame is in its pulled out position to free the drum and to enable the drum to be lifted vertically from between the frame plates for inspection or replacement.

7. The combination as claimed in claim 1 or in claim 3 or in claim 6 in which the one-way clutches are of the type having an inner shaft and concentric outer sleeve defining an annular space between them, the annular space being occupied by a series of peripherally spaced captive rollers, the outer sleeve being formed with ramps for the individual rollers so that in one direction of relative rotation of the rollers are loose and so that in the opposite direction of relative rotation the rollers are crowded inwardly upon the shaft thereby to provide a torque transmitting connection, the shaft being axially separable from the sleeve and its rollers.

* * * * *